US007740724B2

(12) United States Patent
Clemens

(10) Patent No.: US 7,740,724 B2
(45) Date of Patent: Jun. 22, 2010

(54) METHOD FOR PREVENTING FORMATION OF CELLULAR GAMMA PRIME IN CAST NICKEL SUPERALLOYS

(75) Inventor: Reade R. Clemens, Plainville, CT (US)

(73) Assignee: United Technologies Corporation, Hartford, CT (US)

( * ) Notice: Subject to any disclaimer, the term of this patent is extended or adjusted under 35 U.S.C. 154(b) by 381 days.

(21) Appl. No.: 11/582,726

(22) Filed: Oct. 18, 2006

(65) Prior Publication Data

US 2010/0084107 A1 Apr. 8, 2010

(51) Int. Cl.
*C22F 1/10* (2006.01)
*C22C 19/05* (2006.01)

(52) U.S. Cl. ..... 148/676; 148/410; 420/448

(58) Field of Classification Search ..... 148/675–677
See application file for complete search history.

(56) References Cited

U.S. PATENT DOCUMENTS 4,491,302 A * 1/1985 Asari et al. ..... 266/87
4,574,015 A * 3/1986 Genereux et al. ..... 148/677
5,527,403 A 6/1996 Schirra et al.
5,788,785 A 8/1998 DeLuca et al.
7,115,175 B2 10/2006 DeLuca et al.
2006/0016527 A1 1/2006 Yoshioka et al.

FOREIGN PATENT DOCUMENTS

GB 1 510 824 A 5/1978
WO WO 0164964 A 9/2001

OTHER PUBLICATIONS

I. Koizumi and M. Nishihara, Isostatic pressing, technology and applications, Elsevier Science Publishers Ltd., 1992, pp. 152-161, XP002469451, ISBN 1-85166-596-X.

* cited by examiner

*Primary Examiner*—Roy King
*Assistant Examiner*—Jessee R. Roe
(74) *Attorney, Agent, or Firm*—Bachman & LaPointe, P.C.

(57) ABSTRACT

A method for preventing the formation of cellular gamma prime in nickel-based superalloys comprises the steps of: casting a nickel-based superalloy into a desired article; subjecting the cast article to hot isostatic pressing at a temperature in excess of 2000° F. at a pressure greater than 15,000 psi to close internal pores in the cast article; and avoiding any formation of the cellular gamma prime in the cast article.

8 Claims, 1 Drawing Sheet

METHOD FOR PREVENTING FORMATION OF CELLULAR GAMMA PRIME IN CAST NICKEL SUPERALLOYS

BACKGROUND (1) Field of the Invention

The present invention relates to a method for preventing the formation of cellular gamma prime in cast nickel-based superalloys.

(2) Prior Art

In cast nickel-based superalloys, the cellular gamma prime precipitate is clearly undesirable. The cellular form of gamma prime, shown by the circled sites in FIG. 1, is not broadly known. In some cast nickel-based superalloys, it has been observed after hot isostatic pressing (HIP). Once formed, the gamma prime precipitate is difficult to dissolve as compared to the cuboidal form of gamma prime, which is familiar and essential for good performance under high temperature and stress. Creep rupture testing for material containing just low levels of cellular gamma prime have shown significant reductions in life. FIG. 2 illustrates these reductions in life.

Thus, there is a need for a method for preventing the formation of cellular gamma prime in cast nickel-based superalloys.

SUMMARY OF THE INVENTION

Accordingly, there is provided by the present invention a method for preventing the formation of cellular gamma prime in cast nickel-based superalloys.

In accordance with the present invention, a method for preventing the formation of cellular gamma prime in nickel-based superalloys broadly comprises the steps of: casting a nickel-based superalloy into a desired article; subjecting said cast article to hot isostatic pressing at a temperature in excess of 2000° F. at a pressure greater than 15,000 psi to close internal pores in said cast article; and avoiding any formation of said cellular gamma prime in said cast article.

Other details of the method to prevent formation of cellular gamma prime in cast nickel superalloys of the present invention, as well as other objects and advantages attendant thereto, are set forth in the following detailed description.

DETAILED DESCRIPTION OF THE PREFERRED EMBODIMENT(S)

Figure 1:
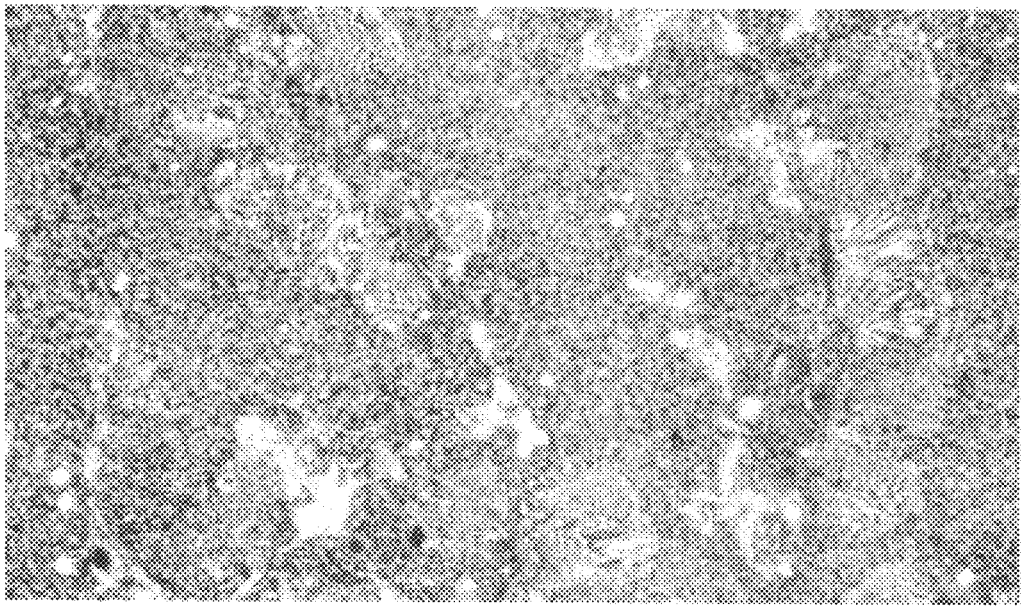
FIG. 1 is a photomicrograph showing cellular gamma prime sites in a nickel-based superalloy.
Figure 2:
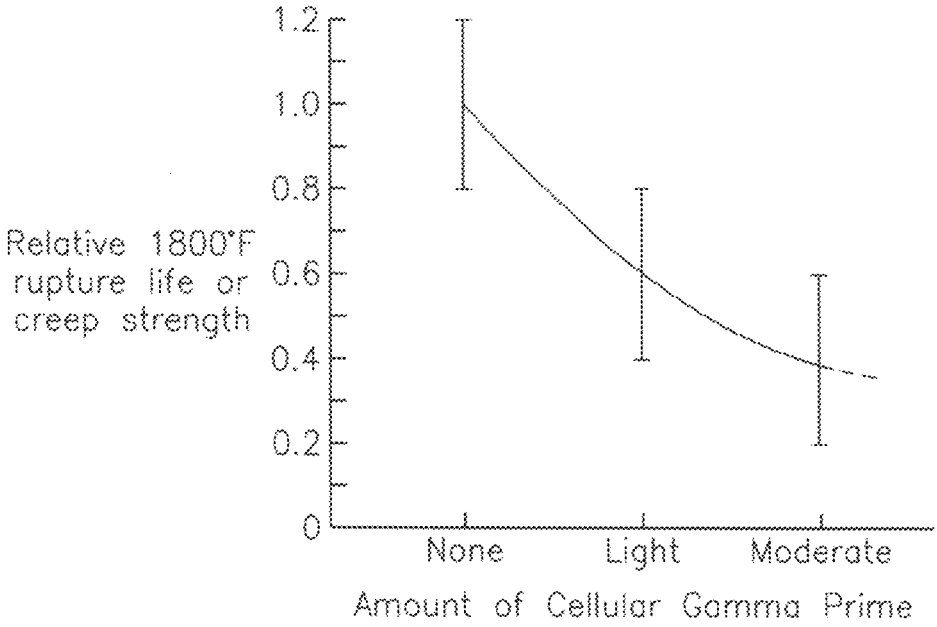
FIG. 2 is a graph showing the relative 1800° F. properties as a function of the amount of cellular gamma prime.

In accordance with the present invention, an article, such as a turbine engine component, is formed from a nickel-based superalloy. For example, the article may be formed from a nickel based superalloy having a composition containing from 12 to 13 wt % chromium, from 8.0 to 10 wt % cobalt, from 2.0 to 3.0 wt % molybdenum, from 3.0 to 5.0 wt % tungsten, from 3.0 to 5.0 wt % titanium, from 4.0 to 5.0 wt % tantalum, from 3.0 to 4.0 wt % aluminum, from 0.01 to 0.02 wt % boron, from 0.03 to 0.12 wt % zirconium, from 0.4 to 0.6 wt % hafnium, from 0.1 to 0.15 wt % carbon, and the balance nickel. The article may be formed by using any suitable casting technique known in the art.

After the cast article has been formed, it may be placed into a chamber or a vessel where a hot isostatic pressing step is performed to close internal pores in the cast article. While the present invention will be discussed in the context of a single cast article, a plurality of cast articles may be placed in the chamber or vessel and simultaneously subjected to the hot isostatic pressing step. Any suitable atmosphere known in the art may be used in the chamber, such as an argon gas atmosphere, during the hot isostatic pressing step.

The hot isostatic pressing step typically begins by applying high temperatures, usually over 2000° F., and a high pressure, usually over 15,000 psi. A typical maximum temperature for use during the hot isostatic pressing step is in the range of from 2165° F. to 2215° F. After a period of time, usually several hours, the hot isostatic pressing step ends with a practically simultaneous decrease in both temperature and pressure until ambient or safe conditions are reached to remove the cast article(s) from the chamber or vessel. It is during this conclusion to the hot isostatic pressing step that the unwanted cellular gamma prime sites are formed.

In accordance with the present invention, the conclusion of the hot isostatic pressing step is altered to avoid the formation of the cellular gamma prime sites in the nickel-based superalloy cast article. This is done by decreasing the pressure independently while maintaining the high temperature for an additional period of time, such as less than one hour. In order for this step to work, the additional time period must be at least ten minutes. The level of lower pressure sufficient to begin this additional high temperature period can range from a pressure significantly below the maximum hot isostatic pressing step pressure to ambient pressure. A preferred lower range is from 3,000 to 5,000 psi. Once the short period of reduced pressure ends, the high temperature used during the hot isostatic pressing step can be decreased until a temperature is reached where it is safe to remove the cast article(s) from the chamber or vessel.

The intent of the modified end to the hot isostatic pressing step is to allow deformation healing and residual stress relief to take place prior to the start of gamma prime precipitation.

After the cast article(s) have been removed from the chamber or vessel, the cast article(s) may be subjected to additional heat treatments if desired and/or additional finishing operations.

The elimination of the cellular gamma prime sites will improve the stress rupture life of the cast articles formed from the nickel-based superalloys. It will also make the microstructure more uniform. Still further, elimination of the cellular gamma prime sites may also eliminate cracking problems during manufacture.

It is apparent that there has been provided in accordance with the present invention a method for preventing the formation of cellular gamma prime in cast nickel superalloys which fully satisfies the objects, means and advantages set forth hereinbefore. While the present invention has been discussed in the context of specific embodiments thereof, other unforeseeable alternatives, modifications, and variations may become apparent to those skilled in the art having read the foregoing detailed description. Accordingly, it is intended to embrace those alternatives, modifications, and variations as fall within the broad scope of the appended claims.

What is claimed is:

1. A method for preventing the formation of cellular gamma prime in nickel-based superalloys comprising the steps of:

casting a nickel-based superalloy into a desired article;

placing said cast article into a chamber;

subjecting said cast article while in said chamber to hot isostatic pressing at a temperature in excess of 2000° F. at a maximum pressure greater than 15,000 psi to close internal pores in said cast article; and avoiding any formation of said cellular gamma prime in said cast article, said avoiding step comprising concluding said hot isostatic pressing step by decreasing said maximum pressure while maintaining said temperature for a time period prior to removing said cast article from the chamber.

2. The method according to claim 1, wherein said temperature maintaining step comprises maintaining said temperature for a time period less than one hour but greater than ten minutes.

3. The method according to claim 1, wherein said pressure decreasing step comprises decreasing said pressure to a level below the maximum pressure applied during said hot isostatic pressing step to ambient pressure.

4. The method according to claim 3, wherein said pressure decreasing step comprises decreasing the pressure to a pressure in the range from 3,000 to 5,000 psi.

5. The method according to claim 1, wherein said gamma prime formation avoiding step further comprises decreasing said temperature after said time period has elapsed to a temperature at which said cast article may be removed from the chamber.

6. The method according to claim 1, wherein said casting step comprises casting said nickel-based superalloy so as to form a turbine engine component.

7. The method according to claim 1, wherein said casting step comprises casting a nickel-based superalloy having a composition containing from 12 to 13 wt % chromium, from 8.0 to 10 wt % cobalt, from 2.0 to 3.0 wt % molybdenum, from 3.0 to 5.0 wt % tungsten, from 3.0 to 5.0 wt % titanium, from 4.0 to 5.0 wt % tantalum, from 3.0 to 4.0 wt % aluminum, from 0.01 to 0.02 wt % boron, from 0.03 to 0.12 wt % zirconium, from 0.4 to 0.6 wt % hafnium, from 0.1 to 0.15 wt % carbon, and the balance nickel.

8. The method according to claim 1, wherein said hot isostatic pressing step comprises subjecting said cast article to a temperature in the range of from 2165° F. to 2215° F.

* * * * *